US009803952B2

(12) United States Patent
Giaretta

(10) Patent No.: US 9,803,952 B2
(45) Date of Patent: Oct. 31, 2017

(54) BB-SHOT LOADING SYSTEM FOR AN AIR WEAPON AND AIR WEAPON COMPRISING SUCH SYSTEM

(71) Applicant: Demis Giaretta, Altavilla Vicentina (IT)

(72) Inventor: Demis Giaretta, Altavilla Vicentina (IT)

( * ) Notice: Subject to any disclaimer, the term of this patent is extended or adjusted under 35 U.S.C. 154(b) by 0 days.

(21) Appl. No.: 15/112,366

(22) PCT Filed: Jan. 21, 2015

(86) PCT No.: PCT/IB2015/050473
§ 371 (c)(1),
(2) Date: Jul. 18, 2016

(87) PCT Pub. No.: WO2015/114494
PCT Pub. Date: Aug. 6, 2015

(65) Prior Publication Data

US 2016/0334186 A1 Nov. 17, 2016

(30) Foreign Application Priority Data

Jan. 31, 2014 (IT) ..... VI2014A0031

(51) Int. Cl.
*F41B 11/00* (2013.01)
*F41B 11/54* (2013.01)
(Continued)

(52) U.S. Cl.
CPC ..... *F41B 11/54* (2013.01); *F41A 9/83* (2013.01); *F41B 11/50* (2013.01); *F41B 11/51* (2013.01); *F42B 6/10* (2013.01)

(58) Field of Classification Search
CPC F41B 11/54; F41B 11/50; F41B 11/51; F41B 6/10; F41A 9/83
(Continued)

(56) References Cited

U.S. PATENT DOCUMENTS 3,212,489 A * 10/1965 Merz ..... F41B 11/54 124/36
3,236,222 A * 2/1966 Pitcher ..... F41B 11/723 124/36
(Continued)

FOREIGN PATENT DOCUMENTS

| | | |
|---|---|---|
| EP | 2573503 | 3/2013 |
| JP | 2004309040 | 11/2004 |
| WO | 2013144920 | 10/2013 |

OTHER PUBLICATIONS

Esa Toivonen: "40 mm BB showers put to a test", Airsoft Soldier, No. 1, Jun. 19, 2008 (Jun. 19, 2008), pp. 22-27, XP055140767, ISSN: 1797-7444.

*Primary Examiner* — Samir Abdosh
(74) *Attorney, Agent, or Firm* — Themis Law

(57) ABSTRACT

A system for loading BB-shot into an air weapon includes a loader for storing BB-shot having an aperture, a pressure system promoting forced transfer of the BB shot through the aperture, a cartridge with a cylindrical body having axial channels offset by a predetermined angular pitch for housing rows of BB-shot balls, an elastic occluding member for holding the rows of BB-shot balls in the channels, an intermediate cylindrical element having a passage with an inlet communicating with the aperture and an outlet to be longitudinally aligned to one of the channels, a detaching member interacting with the occluding member for locally disabling it at the outlet and allowing a row of BB-shot balls to be transferred into the channel. The cartridge is rotatable about the longitudinal axis relative to the intermediate element for aligning the outlet of the passage with one channel at a time.

10 Claims, 4 Drawing Sheets

(51) Int. Cl.

| | |
|---|---|
| ***F42B 6/10*** | (2006.01) |
| ***F41A 9/83*** | (2006.01) |
| ***F41B 11/51*** | (2013.01) |
| ***F41B 11/50*** | (2013.01) |

(58) Field of Classification Search
USPC ..... 124/71
See application file for complete search history.

(56) References Cited

U.S. PATENT DOCUMENTS

| | | | | | |
|---|---|---|---|---|---|
| 3,236,224 | A * | 2/1966 | Pitcher | F41A 17/38 | 124/53 |
| 4,422,433 | A * | 12/1983 | Milliman | F41A 9/28 | 124/44.7 |
| 5,592,931 | A * | 1/1997 | Johnson | F41B 11/54 | 124/48 |
| 5,596,978 | A * | 1/1997 | Johnson | F41B 11/54 | 124/48 |
| 5,791,325 | A * | 8/1998 | Anderson | F41B 11/53 | 124/49 |
| 5,816,232 | A * | 10/1998 | Bell | F41B 11/53 | 124/48 |
| 6,364,162 | B1 * | 4/2002 | Johnson | F41B 9/0018 | 222/61 |
| 9,417,031 | B2 * | 8/2016 | Giaretta | F41B 11/62 | |
| 2001/0027786 | A1 * | 10/2001 | Kunimoto | F41B 11/54 | 124/73 |
| 2011/0023858 | A1 * | 2/2011 | Andresen | F41A 9/02 | 124/51.1 |
| 2011/0083654 | A1 * | 4/2011 | Galinson | F41A 9/36 | 124/59 |
| 2015/0013655 | A1 * | 1/2015 | Giaretta | F41B 11/62 | 124/73 |

* cited by examiner

BB-SHOT LOADING SYSTEM FOR AN AIR WEAPON AND AIR WEAPON COMPRISING SUCH SYSTEM

FIELD OF THE INVENTION

The present invention generally finds application in the field of air weapons, and particularly relates to a system for loading BB-shot into an air weapon.

The invention also relates to an air weapon incorporating such system.

BACKGROUND ART

Air weapons are known to be used in a sport known as airsoft, which are adapted to allow simultaneous ejection of one or more BB shot balls at a time.

Particularly, in the practice of this sport, air weapons are frequently used, which can fire one BB shot ball at a time in automatic or semiautomatic fashion, i.e. with a very high ejection frequency.

These weapons have a BB shot loading system, which is adapted to promote automatic transfer of a single BB shot ball into the firing chamber at the same time as the trigger is actuated by the user.

U.S. Pat. No. 5,816,232, US 2011/0023858 and U.S. Pat. No. 5,791,325 disclose three different exemplary configurations of a loading system of this type for use in an air gun or rifle.

U.S. Pat. No. 5,816,232 discloses a device comprising a main body mounted outside the weapon and adapted to contain the BB-shot, said body having an aperture directly connected with the firing chamber of the weapon.

Particularly, the BB-shot is fed to the firing chamber by a motor-driven paddle, rotated in synchronism with the actuation of the trigger.

US 2011/0023858 discloses a BB-shot container directly connected to the firing chamber via a flexible feeding conduit.

A rotating wheel is placed internally of the container, and comprises a plurality of radially offset recesses which are specially shaped to receive respective BB-shot balls such that they may be held therein and transferred to the flexible feeding conduit by a rotation controlled by trigger actuation.

U.S. Pat. No. 5,791,325 discloses a loading system comprising a BB-shot container connected to the firing chamber of the weapon and adapted to transfer the BB-shot therein by gravity.

The system also has sensor means for detecting the BB-shot in the feeding conduit and indicate the absence of BB-shot in the container, when appropriate.

Nevertheless, a different type of air weapons, which are typically used in airsoft use cartridges, commonly known as grenades or BB-showers, which are adapted to allow simultaneous ejection of a plurality of BB-shot balls upon actuation of the trigger by a user.

Generally, these cartridges are housed in the firing chamber of the weapon and comprise a cylindrical body having a plurality of channels, designed to contain respective rows of BB-shot balls.

The BB-shot is prevented from coming out of the channels before firing by the presence of an appropriate holding element, which is located in a seat formed on the outer surface of the cylindrical body.

In the most common embodiments, these holding elements are made of an elastic material and include seals, O-rings and other similar elements.

The cartridges are loaded with BB-shot using appropriate manual loading means.

For example, TWM283155 discloses a loading device having a hollow BB-shot containing body and a manual mechanism for promoting BB-shot transfer through an outlet.

A first drawback of these arrangements is that the BB-shot loading systems integrated in automatic or semi-automatic weapons only allow one BB-shot ball to be loaded at a time, and to be directly transferred into the firing chamber.

These systems do not allow loading of a cartridge to be housed in the firing chamber of the weapon and having a plurality of channels designed to be filled with BB-shot.

A further drawback of these arrangement is that manual loading devices only allow cartridges to be loaded when they are removed from the firing chamber, and the user is unable to use the weapon during loading.

To avoid the need of stopping the airsoft session during loading, the user may be equipped with a plurality of pre-loaded cartridges, which might be a burden or a hindrance for his/her movements or, more often, might be lost.

Furthermore, an additional drawback of these arrangements is that one actuation of the manual loading devices only allows loading of one BB-shot channel, which considerably increases the overall cartridge loading times.

These drawbacks may further be a serious disadvantage for an airsoft player, preventing him/her from actively taking part in the action if hew/she has run out of the cartridges and is reloading them.

A further drawback of these arrangements is that the manual loading device is not integrated in the weapon and may be easily forgotten or lost.

Thus, if the loading device is lost, the player may be obliged to withdraw from the airsoft session because he/she will no longer be able to load his/her empty cartridges and will remain without ammunition.

DISCLOSURE OF THE INVENTION

The object of the present invention is to obviate the above drawbacks, by providing a system for loading BB-shot into an air weapon, that is highly efficient and relatively cost-effective.

A particular object of the present invention is to provide a BB-shot loading system that allows an air weapon to be loaded in a very short time.

Another object of the present invention is to provide a system for loading BB-shot into an air weapon that allows constant loading of the weapon without requiring removal of the cartridge.

A further object of the present invention is to provide a BB-shot loading system that allows automatic and/or semi-automatic loading of an air weapon.

These and other objects, as better explained hereafter, are fulfilled by a system for loading BB-shot into an air weapon as defined in claim 1.

In a further aspect, the invention relates to an air weapon incorporating such loading system, as defined in claim 10.

With these features, BB-shot may be loaded into an air weapon in a relatively short time, without removing the cartridge from the weapon.

Advantageous embodiments of the invention are defined in accordance with the dependent claims.

BRIEF DESCRIPTION OF THE DRAWINGS

Further characteristics and advantages of the invention will become more apparent upon reading of the detailed description of a few preferred, non-exclusive embodiments of a BB-shot loading system for an air weapon, and a weapon in which such system is installed, which are described as non-limiting examples with the help with the accompanying drawings in which.

DETAILED DESCRIPTION OF A PREFERRED EMBODIMENT

Figure 1:
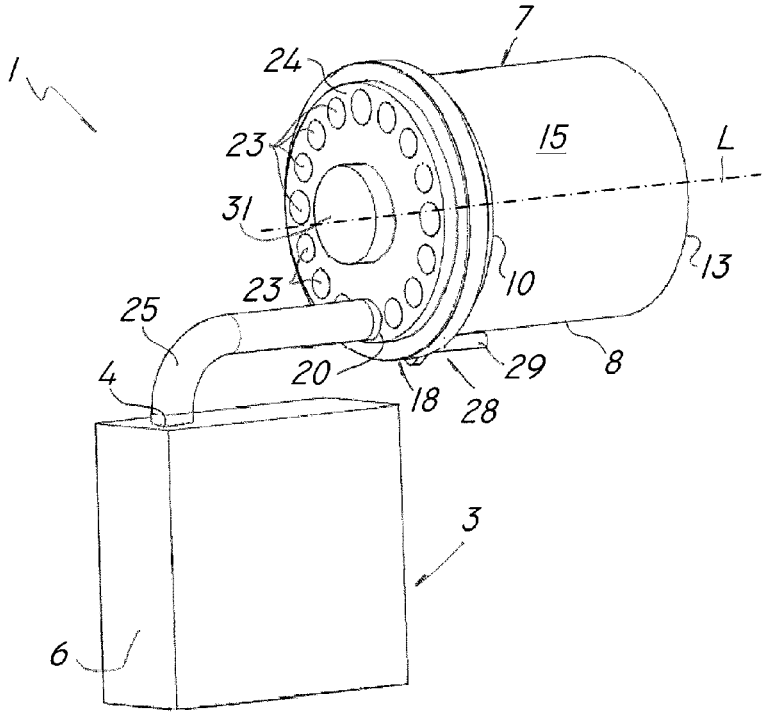
FIG. 1 is a perspective view of a first embodiment of a loading system of the invention.

The accompanying figures show a loading system, generally designated by numeral 1, which is designed to load BB-shot into an air weapon, generally designated by numeral 2.

Particularly, this system 1 is particularly suitable for installation on air weapons 2 as used in the practice of airsoft and designed to simultaneously fire a plurality of BB-shot balls P at a time.

In the basic embodiment, as best shown in FIGS. 1 to 4, the system 1 for loading BB-shot P comprises a loader 3, which is designed to be coupled to a weapon 2 and to store a predetermined amount of BB-shot balls P.

The loader 3 further has an aperture 4 for pressure transfer of at least one BB-shot ball P at a time, and pressure means 5 acting on the stored BB-shot P to promote forced transfer thereof through the aperture 4.

Figure 3:
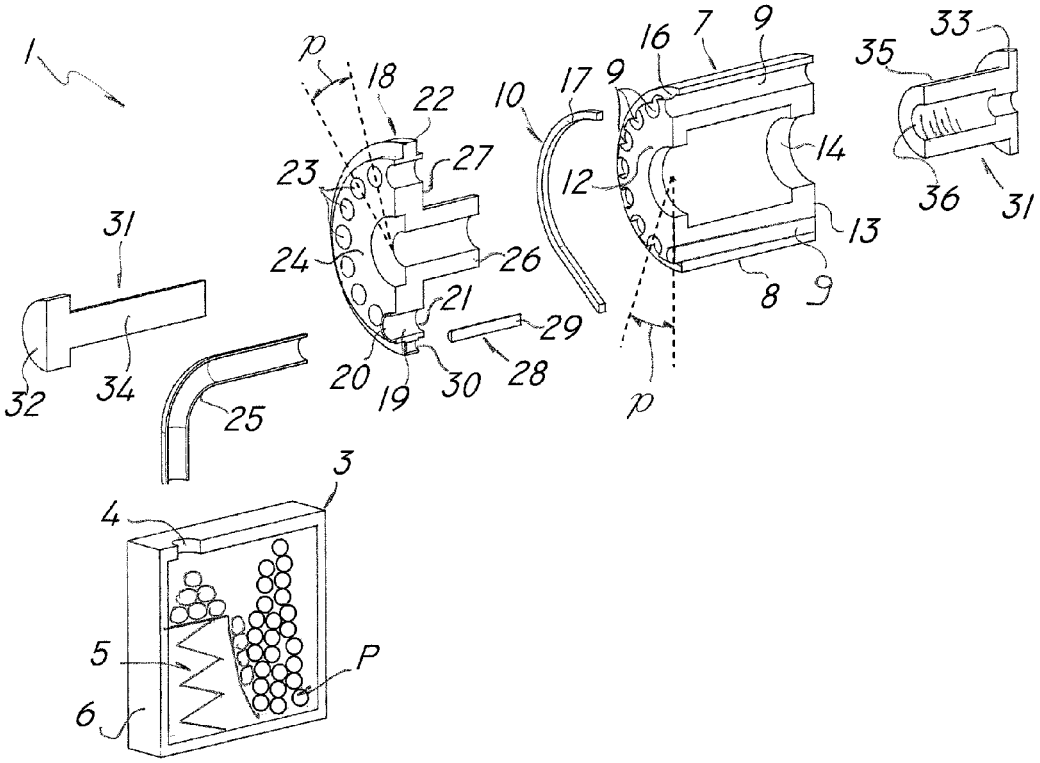
FIG. 3 is an exploded broken-away perspective view of the system of FIG. 1.
Figure 4:
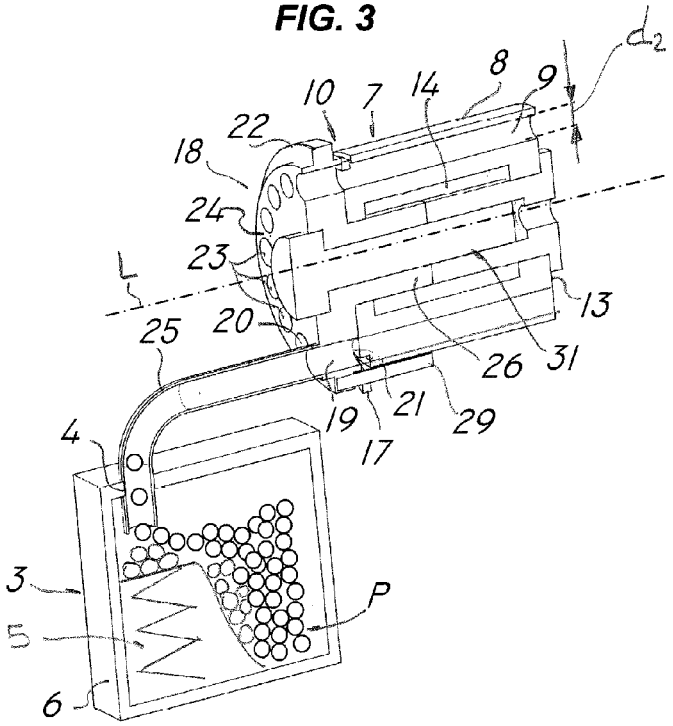
FIG. 4 is a broken-away perspective view of the system of FIG. 1.
Figure 5:
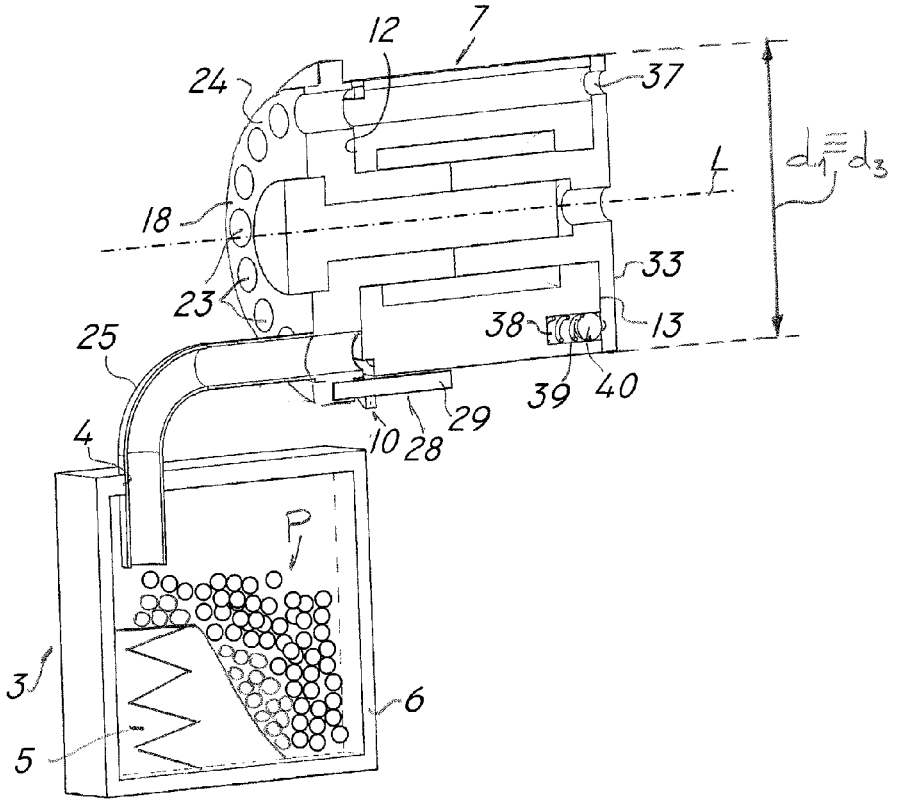
FIG. 5 is a broken-away perspective view of a second embodiment of a loading system of the invention.

The pressure means 5, which are schematically shown in FIGS. 3 to 5, may comprise a pusher device, not shown, for conveying BB-shot P toward the aperture 4 with a predetermined pressure, and promote continuous feeding thereof.

In the illustrated configurations of the invention, the loader 3 comprises a substantially rectangular box-like body 6 containing the BB-shot, which is adapted to be removably inserted into a housing in the weapon 2, not shown.

Nevertheless, the loader 3 may have shapes other than the rectangular shape and be configured to remain outside the weapon 2. For example, the loader 3 may be a portable container, adapted to be attached to the body of the user and be associated with the weapon 2 via a flexible feeding tube, not shown.

The system 1 also comprises a cartridge 7 with a cylindrical body 8 defining a longitudinal axis L. This body 8 is designed to be positioned in the weapon and comprises a plurality of axial channels 9, offset by a predetermined angular pitch p for housing respective rows of BB-shot balls P.

If the weapon 2 is designed to fire BB-shot having a diameter of 6 mm, the cylindrical body 8 may have a diameter $d_1$ substantially close to 40 mm and the channels 9 may have equal diameters $d_2$, slightly greater than 6 mm.

Figure 2:
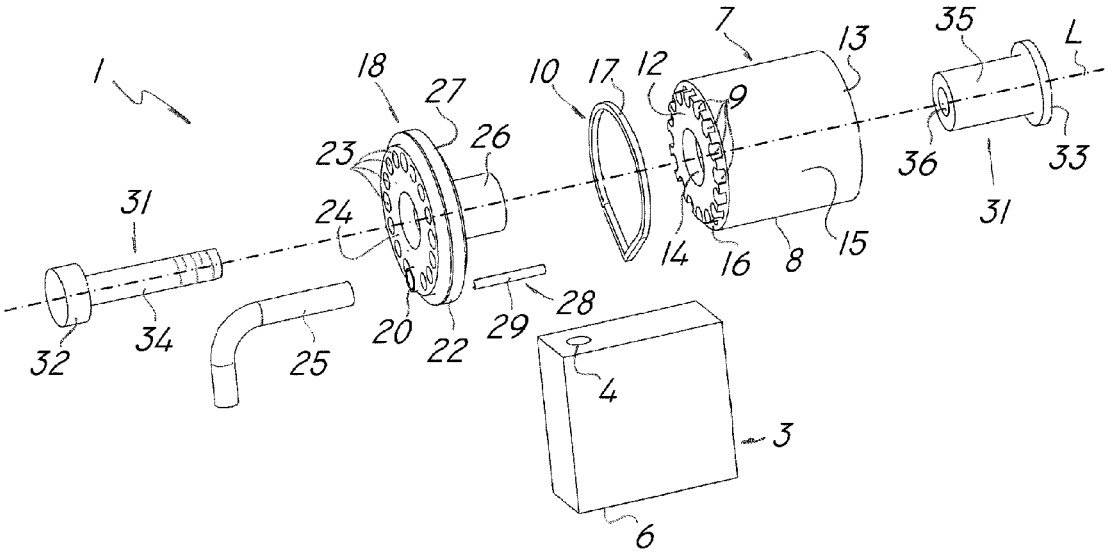
FIG. 2 is an exploded perspective view of the system of FIG. 1.

In a particular configuration of the invention, as best shown in FIG. 2, the cylindrical body 8 may be formed with sixteen axial channels 9, offset by a substantially constant angular pitch p, close to about 23° C.

Furthermore, an elastic occluding member 10 is associated with the cartridge 7 to hold the rows of BB-shot balls P introduced into the channels 9.

Preferably, as shown in the figures, the elastic member 10 will be adapted to only partially occlude the axial channels 9 to prevent the BB-shot P from coming out of them while the cartridge 7 is being handled, and oppose a reduced resistance when the BB shot is ejected upon actuation of the trigger 11 of the weapon 2.

Conveniently, as shown in FIGS. 2 to 5, the cartridge 7 may have a pair of substantially flat end faces 12, 13 and a central axial hole 14.

Furthermore, an annular seat 16 may be formed on the outer surface 15 of the cylindrical body 8, for housing the elastic occluding member 10.

The annular seat 16 may be formed proximate to an end face 12 of the cylindrical body 8 and the elastic occluding member 10 may be an O-ring 17 made of rubber or another similar material, as shown in FIGS. 2 and 3.

The system 1 also comprises a substantially cylindrical intermediate element 18 with a passage 19 having an inlet 20 for the BB-shot P, communicating with the aperture 4 of the loader 3, and an outlet 21 for the BB-shot P, as shown in FIG. 3, which is designed to be longitudinally aligned with one of the channels 9 of the cartridge 7.

Conveniently, as clearly shown in FIGS. 2 and 3, the intermediate element 18 may comprise a main portion 22 with a plurality of through holes 23, which are offset by the same pitch p as the channels 9 of the cartridge 7 and designed to be aligned therewith.

The main portion 22 may be disposed at the front of the cartridge 7 to promote axial alignment of the holes 23 with the channels 9 formed therein.

The inlet 20 of the passage 19 may be formed in the front surface 24 of the main portion 22 and may be connected to the aperture 4 of the loader 3 via a tubular conduit 25 whose diameter substantially corresponds to the diameter of the BB-shot P.

The intermediate element 18 may further comprise a substantially tubular axial projection 26, which extends from the main portion 22 and is adapted to be inserted into the central hole 14 of the cartridge 7.

Particularly, as best shown in FIGS. 2 and 3, the main portion 22 may comprise a substantially flat rear surface 27 joined to the tubular projection 26.

As the projection 26 is introduced into the central hole 14, the rear surface 27 may be caused to contact one of the end faces 12, 13 of the cylindrical body 8.

Particularly, the rear surface 27 of the main portion 22 may contact the end face 12 of the cylindrical body 8 located proximate to the annular seat 16 of the O-ring 17.

A detaching member 28 is also provided, which interacts with the elastic occluding member 10 to locally disable it at the outlet 21 of the passage 19.

This will promote the transfer of a row of BB-shot balls P into the channel 9 aligned with the outlet 21 of the passage 19.

Particularly, as best shown in FIGS. 2 to 5, the detaching member 28 may comprise a pin 29 that can be axially inserted between the cartridge 7 and the occluding member 10 and is adapted to detach the latter from the outer surface 15 of the cartridge 7 thereby promoting its local removal from the annular seat 16 at the outlet 21 of the passage 19.

In the illustrated configuration of the invention, the detaching member 28 may be stationary and rigidly joined to the intermediate element 18.

Particularly, as clearly shown in FIG. 3, the main portion 22 may have a housing hole 30 for the pin 29, which is radially aligned with the passage 19 and outwardly offset therefrom.

Advantageously, the cartridge 7 is designed to be rotated by a predetermined angular pitch p about the longitudinal axis L relative to the intermediate element 18.

This will allow the outlet 21 of the passage 19 to be aligned with one respective channel 9 of the cartridge 7 at a time, for sequential introduction of rows of BB-shot balls P.

Preferably, as best shown in FIGS. 2 to 5, the system 1 may comprise a spindle 31 that is designed to be received in the tubular projection 26 and the central hole 14 to allow relative rotation of the intermediate element 18 and the cartridge 7.

The spindle 31 may have a pair of ends 32, 33 adapted to be coupled to the intermediate element 18 and the cartridge 7 for holding them in mutual axial contact.

Particularly, the spindle 31 may comprise a first threaded cylindrical portion 34 having a disk-shaped end 32 which is designed to be coupled to the front surface 24 of the main portion 22.

The spindle 31 may further comprise a second cylindrical portion 35 having a matingly threaded axial hole 36, for the first cylindrical portion 34 to be tightened to and loosened from it.

The second portion 35 of the spindle 31 may also have the other end 33, which is also shaped like a disk and designed to be coupled to one of the end faces 13 of the cylindrical body 8.

In the configuration of the invention as shown in FIG. 5, which features a non-self-triggering cartridge 7, one end 33 of the spindle may have a diameter $d_3$ substantially corresponding to the diameter $d_1$ of the cylindrical body 8 and may comprise additional through holes 37 that are adapted to be angularly aligned with the channels 9 to receive pressurized gas upon actuation of the trigger 11 by the user.

In a preferred configuration of the invention, as shown in FIGS. 1 to 5, the intermediate element 18 and the detaching member 28 are stationary, whereas the cartridge 7 is able to rotate about the longitudinal axis L for the relative rotation to take place, with the predetermined pitch p.

The rotation of the cartridge 7 may be manually promoted by the user, otherwise the system may comprise automatic rotation means, not shown, for promoting the rotation of the cartridge 7 by a predetermined angular pitch p.

If the cartridge 7 is manually rotated, it may have a blind hole 38 formed at the end face 13 of the cylindrical body 8 that is distal from the annular seat 16, as best shown in FIG. 5.

A spring 39 may be received in the blind hole 38, for outwardly biasing a ball 40 which is designed for snap engagement of one of the through holes 37 formed on one end 33 of the spindle 31.

Thus, during manual rotation of the cartridge 7, the action of the spring 39 will allow the ball 40 to successively engage the holes 37 of the end 33 of the spindle 31, thereby promoting alignment of the outlet 21 of the passage 19 with a corresponding channel 9 of the cartridge 7.

Figure 6:
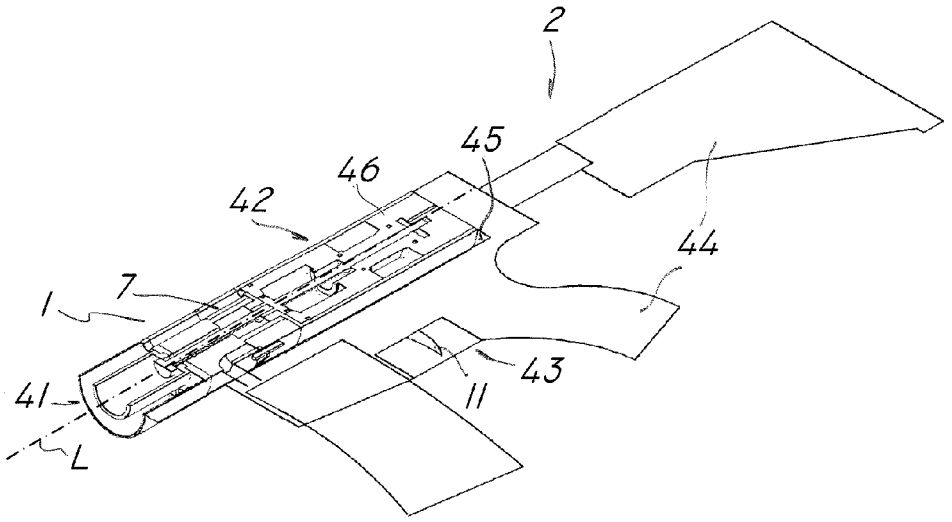
FIG. 6 is a broken-away perspective and schematic view of an air weapon comprising the system of FIG. 1.
Figure 7:
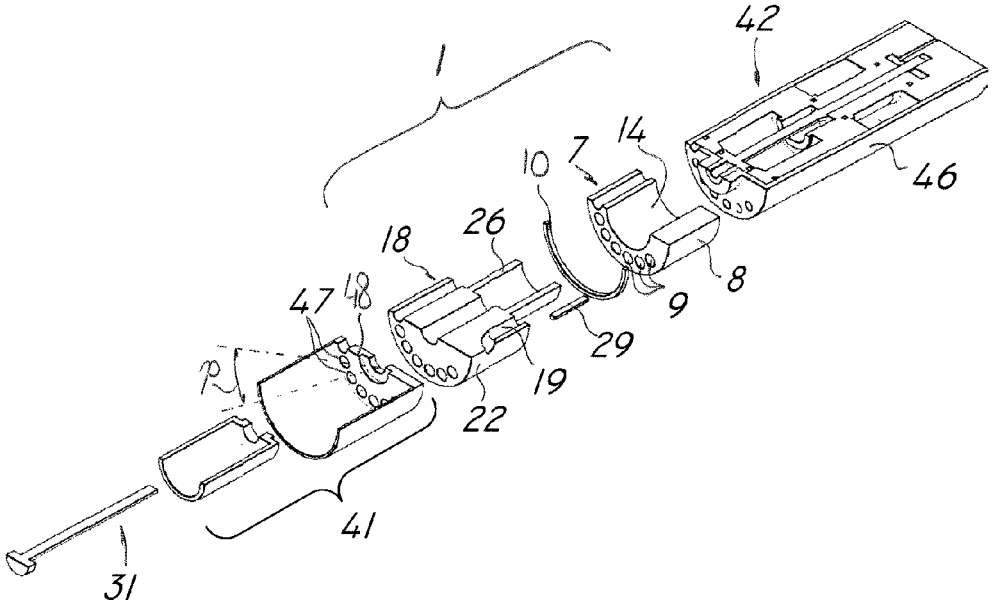
FIG. 7 is a broken-away perspective and exploded view of a first detail of FIG. 6.

In a further aspect, the invention relates to an air weapon 2, as best shown in FIGS. 6 and 7, which comprises a barrel 41 for ejection of at least one BB-shot ball P, means 42 for controlled delivery of a pressurized fluid into the barrel 41 and trigger means 43 comprising the trigger 11, for selectively controlling fluid delivery.

According to a peculiar aspect of the invention, the weapon 2 comprises a system 1 for loading BB-shot P as described above.

Particularly, as shown in the schematic view of FIG. 6, the weapon 44 may comprise a handgrip 44 designed to be held by the user and a trigger 11 for controlling the fluid delivery means 42.

Particularly, the weapon 2 may comprise a longitudinal cavity 45, for housing the loading system 1.

Preferably, the weapon 2 may comprise a housing, not shown, for removably housing the loader 3 of the system 1.

Conveniently, as shown in FIGS. 6 and 7, the fluid delivery means may comprise a device 46 for controlling pressurized fluid delivery, as described in the Italian patent application VI2012A000077, by the applicant hereof.

The control device 46 may comprise a plurality of delivery passages 47, angularly offset by a predetermined pitch p, for alignment with the channels 9 in the cylindrical body 8 of the cartridge 7.

In a particular configuration of the invention, as best shown in FIG. 7, the loading system 1 may be located upstream from the fluid control device 46 and may be removably connected thereto by the spindle 31 that extends in the central hole 14 of the cartridge.

Furthermore, a substantially tubular barrel 41 may be provided upstream from the intermediate device 18, for directing the BB-shot P ejected from the channels 9 due to the water hammer generated by the control device 46.

The barrel 41 may have a perforated end wall 48 joined to the main portion 22 of the intermediate element 18 via the through spindle 31.

The system for loading BB-shot into an air weapon and the air weapon 2 comprising such system according to the invention are susceptible of a number of changes and variants, within the inventive concept as disclosed in the appended claims.

All the details thereof may be replaced by other technically equivalent parts, and the materials may vary depending on different needs, without departure from the scope of the invention.

While the system 1 and weapon 2 of the invention have been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention finds industrial application in the field of air weapons, and particularly in the provision of a system for loading BB-shot into an air weapon and of an air weapon comprising such system.

The invention claimed is:

1. A system (1) for loading BB-shot (P) into an air weapon (2) which comprising:

- a loader (3), configured to be coupled to a weapon (2) for storing a predetermined amount of the BB-shot (P), said loader (3) having an aperture (4) for pressure transfer of at least one BB-shot ball (P) at a time;
- a pressure system (5) acting on the BB-shot (P) stored in the loader (3) to promote forced transfer thereof through said aperture (4);
- a cartridge (7) with a cylindrical body (8) defining a longitudinal axis (L), which is adapted to be placed in said weapon (2) and has a plurality of axial channels (9)

angularly offset by a predetermined angular pitch (p) for housing respective rows of BB-shot balls (P);

an elastic occluding member (10) associated with said cartridge (7) to hold the rows of the BB-shot balls (P) introduced into the channels (9);

a substantially cylindrical intermediate element (18) with a passage (19) having, an inlet (20) for the BB-shot (P) communicating with said aperture (4) of said loader (3), and an outlet (21) for the BB-shot (P) which is designed to be longitudinally aligned with one of said channels (9) of said cartridge (7); and a detaching member (28) interacting with said occluding member (10) for locally disabling said occluding member at said outlet (21) and allowing a row of the BB-shot balls (P) to be transferred into the channel (9) aligned with said outlet (21);

wherein said cartridge (7) is discontinuously rotated by said pitch (p) about said longitudinal axis (L) relative to said intermediate element (18) for aligning said outlet (21) of said passage (19) with one respective channel (9) of said cartridge (7) at a time, to allow sequential introduction of rows of the BB-shot balls (P).

2. The system as claimed in claim 1, wherein said cylindrical body (8) of said cartridge (7) comprises substantially flat end faces (12, 13), a central axial hole (14), and an annular seat (16) formed on an outer surface (15) of said cylindrical body (8), wherein said elastic occluding member (10) comprises an O-ring (17) housed in said annular seat (16).

3. The system as claimed in claim 2, wherein said intermediate element (18) comprises a main portion (22) in which said passage (19) is formed, said main portion (22) having a plurality of through holes (23) angularly offset by the same angular pitch (p) as the channels (9) of said cartridge (7) and adapted to be aligned therewith.

4. The system as claimed in claim 3, wherein said intermediate element (18) comprises a substantially tubular axial projection (26) which extends from said main portion (22) and is designed to be inserted in said central hole (14) of said cartridge (7).

5. The system as claimed in claim 2, wherein said detaching member (28) comprises a pin (29) which is adapted to be axially inserted between said cartridge (7) and said occluding member (10) for detaching the occluding member from an outer surface (15) of said cartridge (7) and promoting local removal thereof from said seat (16) at said outlet (21).

6. The system as claimed in claim 4, further comprising a spindle (31) that is designed to be received in said tubular projection (26) and said central hole 14 of said cartridge (7) to allow relative indexed rotation of the cartridge relative to said intermediate element (18).

7. The system as claimed in claim 6, wherein said spindle (31) has a pair of ends (32, 33) which are designed to be selectively coupled to said intermediate element (18) and said cartridge (7) to hold said intermediate element (18) and said cartridge (7) in mutual axial contact.

8. The system as claimed in claim 6, wherein said detaching member (28) is stationary and rigidly joined to said intermediate element (18).

9. The system as claimed in claim 8, wherein said intermediate element (18) and said detaching member (28) are stationary and said cartridge (7) is adapted to rotate about said longitudinal axis (L) for said relative indexed rotation to take place with said angular pitch (p).

10. An air weapon (2) comprising:

a barrel (41) for ejection of at least one BB-shot ball (P), a system (42) for controlled delivery of a pressurized fluid into said barrel (41), a trigger (43) for selectively controlling the delivery of said fluid, and a system (1) for loading BB-shot (P) comprising:

a loader (3), configured to be coupled to the air weapon (2) for storing a predetermined amount of the BB-shot (P), said loader (3) having an aperture (4) for pressure transfer of at least one BB-shot ball (P) at a time;

a pressure system (5) acting on the BB-shot (P) stored in the loader (3) to promote forced transfer thereof through said aperture (4);

a cartridge (7) with a cylindrical body (8) defining a longitudinal axis (L), which is adapted to be placed in said weapon (2) and has a plurality of axial channels (9) angularly offset by a predetermined angular pitch (p) for housing respective rows of BB-shot balls (P);

an elastic occluding member (10) associated with said cartridge (7) to hold the rows of the BB-shot balls (P) introduced into the channels (9);

a substantially cylindrical intermediate element (18) with a passage (19) having, an inlet (20) for the BB-shot (P) communicating with said aperture (4) of said loader (3), and an outlet (21) for the BB-shot (P) which is designed to be longitudinally aligned with one of said channels (9) of said cartridge (7); and a detaching member (28) interacting with said occluding member (10) for locally disabling said occluding member at said outlet (21) and allowing a row of the BB-shot balls (P) to be transferred into the channel (9) aligned with said outlet (21);

wherein said cartridge (7) is discontinuously rotated by said pitch (p) about said longitudinal axis (L) relative to said intermediate element (18) for aligning said outlet (21) of said passage (19) with one respective channel (9) of said cartridge (7) at a time, to allow sequential introduction of rows of the BB-shot balls (P).

* * * * *